US005095838A

United States Patent [19]

Smith

[11] Patent Number: 5,095,838

[45] Date of Patent: Mar. 17, 1992

[54] CLEW FITTING FOR A BOOM

[75] Inventor: Dennis M. Smith, Perth, Australia

[73] Assignee: Smitech Corporation Pty Ltd., Australia

[21] Appl. No.: 459,778

[22] PCT Filed: Aug. 3, 1988

[86] PCT No.: PCT/AU88/00283

§ 371 Date: Jan. 31, 1990

§ 102(e) Date: Jan. 31, 1990

[87] PCT Pub. No.: WO89/00944

PCT Pub. Date: Feb. 9, 1989

[30] Foreign Application Priority Data

Aug. 4, 1987 [AU] Australia ..... PI3524

[51] Int. Cl.[5] ..... B63H 9/08

[52] U.S. Cl. ..... 114/115; 114/39.2; 114/97; 114/98; 114/102

[58] Field of Search ..... 114/39.2, 97, 98, 102, 114/115

[56] References Cited

U.S. PATENT DOCUMENTS 4,696,248 9/1987 Nedoluha ..... 114/97
4,782,780 11/1988 Smith ..... 114/39.2

FOREIGN PATENT DOCUMENTS 70257 11/1981 Australia .
2855556 7/1980 Fed. Rep. of Germany ..... 114/98
3007107 9/1981 Fed. Rep. of Germany .
3129700 2/1983 Fed. Rep. of Germany ..... 114/97
3326617 2/1985 Fed. Rep. of Germany ..... 114/97
3433227 3/1986 Fed. Rep. of Germany .
3445197 4/1986 Fed. Rep. of Germany .
3500585 7/1986 Fed. Rep. of Germany ..... 114/97

*Primary Examiner*—Sherman Basinger
*Assistant Examiner*—Thomas J. Brahan
*Attorney, Agent, or Firm*—Handal & Morofsky

[57] ABSTRACT

A sailboard boom clew fitting member comprising a pair of members (11 and 12) engagable with the ends of a pair of boom members of the boom. One member (11) having a transversely directed socket. The pawl (13) being snugly engagable in the socket and being retained in engagement by a latch member (22) pivotally supported by one of the members and resiliently biassed into a position at which it will be engaged with the engaged pawl member and socket to prevent their disengagement. The pawl member and socket when engaged providing a support surface (15, 17 and 19) for a rope which fixes the clew of a sail to the clew fitting.

13 Claims, 3 Drawing Sheets

CLEW FITTING FOR A BOOM

This invention relates to sailboards and in particular clew fittings for the wishbone boom of a sailboard.

Sailboards utilise a wishbone boom which comprises a pair of boom members interconnected at one end by a means facilitating mounting of the boom to the mast and interconnected at the other end by means which facilitate the fixing of the clew of the sail to the boom.

It is an object of the present invention to provide a clew fitting for a sailboard wishbone boom which facilitates disconnection of the boom members for stowage and transport.

In one form, the invention resides in a sailboard wishbone boom clew fitting comprising a pair of members wherein one member is adopted to be mounted to one end of one boom member and the other member is adapted to be mounted to one end of the other boom member, the one member having a transversely directed pawl member and the other member is formed with a transversly directed socket which is complementary to the pawl whereby the pawl member is snugly receivable in the socket, wherein one of the members is provided a latch member pivotably supported therefrom which is resiliently biased into a position at which it will be engaged with the engaged pawl member and socket to prevent the disengagement said pawl and socket when engaged providing a support surface for a rope which fixes the clew of a sail to the clew fitting.

According to a preferred feature of the invention, the support surface comprises first slot formed in the pawl member and the outer face of the other member in the region of the socket wherein the said first slots are aligned when the pawl member and socket are in inter-engaged, said slots being located remote from the clew of the sail and are shaped to receive the rope.

According to a preferred feature of the invention the latch member is engagable in a second slot provided in the pawl member and outer face of the other member in the region of the socket said second slots being aligned when the pawl member and the socket are inter-engaged.

According to a preferred feature of the invention the latch is supported by one of the members by a support member formed of resiliently deformable material which provides the resilient biassing, said support member being of fixed to said one of the members.

According to a preferred feature of the invention, the latch member is U-shaped whereby the arms of the latch member are received in and supported from the support element and the web of the latch member is engagable with the inter-engaged pawl member and socket.

According to a preferred feature of the invention, the arms of the latch member extend across the first slot.

According to a preferred feature of the invention, said pawl member when inter-engaged in said socket is capable of rotating pivotal movement in the socket about an axis which is substantially centrally located between the members and is perpendicular to the plane of the boom.

The invention will become fully understood in the light of the following description of one specific embodiment. The description is made with reference to the accompanying drawings of which:

The invention relates to a clew fitting which is to be used with sailboard booms having a mast end fitting of the form disclosed in International Application No. PCT AU86 00241. A feature of the above mentioned mast end fitting facilitates disengagement of the ends of the boom members from each other and from the mast when desired. The present embodiment provides a means of disengaging the clew end of the wishbone boom in order that the boom may be readily disassembled for stowage or transport and then subsequently reassembled.

Figure 1:
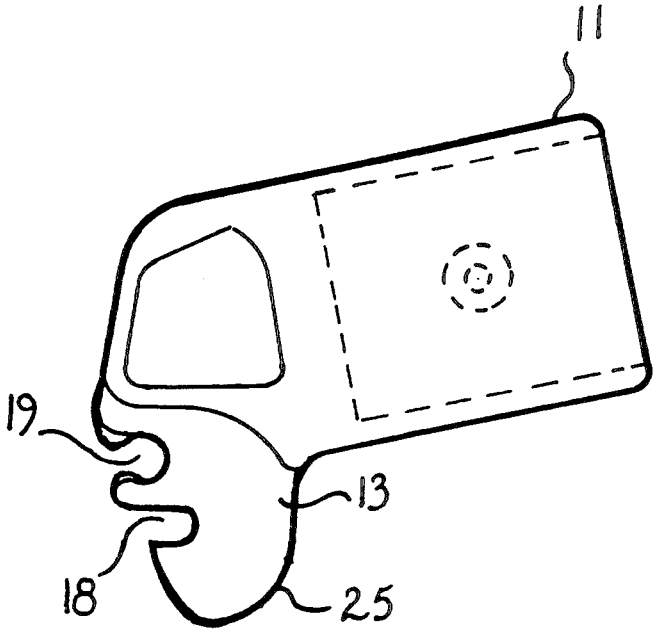
FIG. 1 is a side elevation of one member according to the embodiment.
Figure 2:
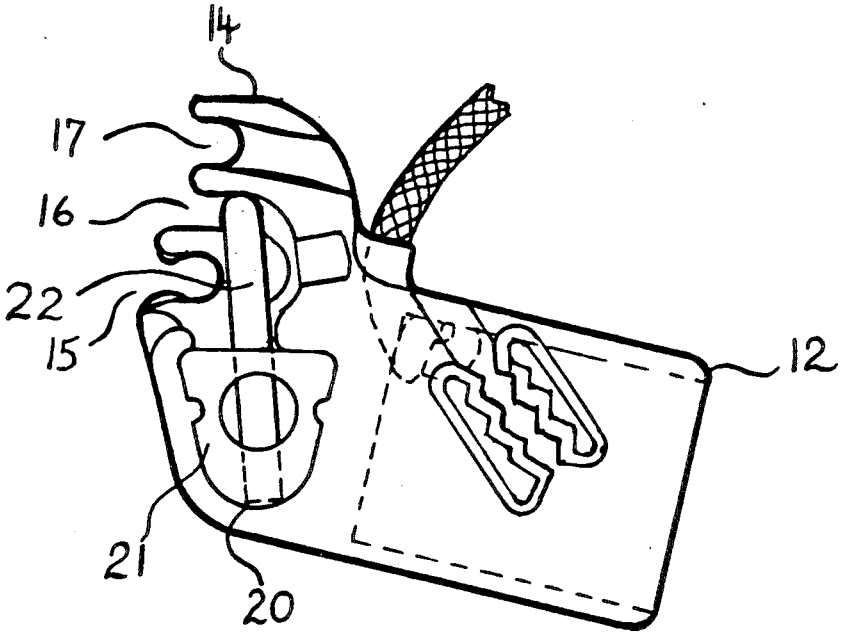
FIG. 2 is a side elevation of the other member according to the embodiment.
Figure 3:
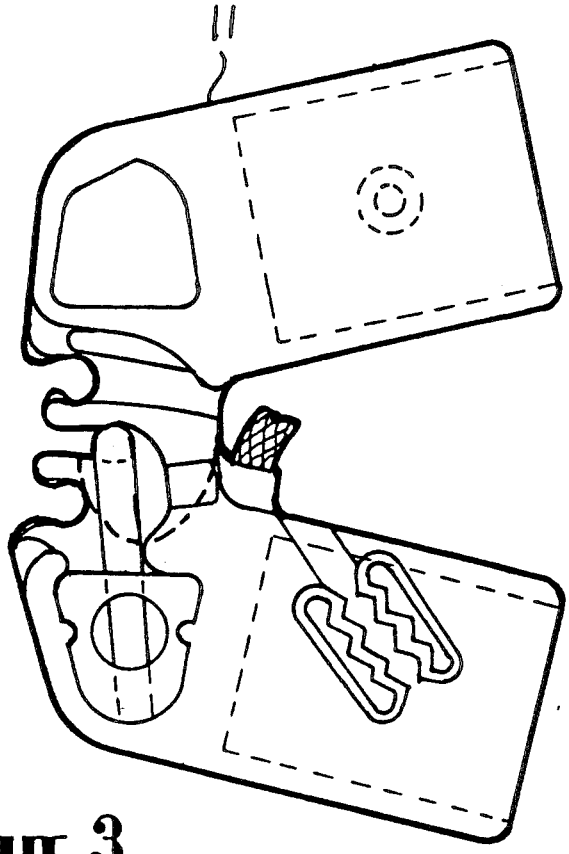
FIG. 3 is a side elevation of the members according to the embodiment in inter-engaging relationship.
Figure 4:
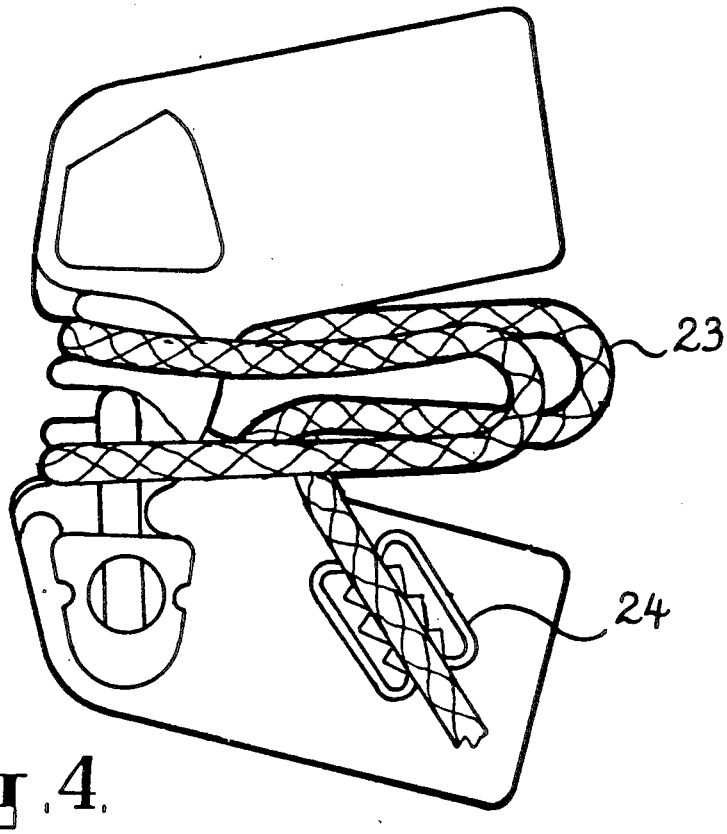
FIG. 4 is a side elevation of the embodiment showing the rope in engagement with the clew fitting.
Figure 6:
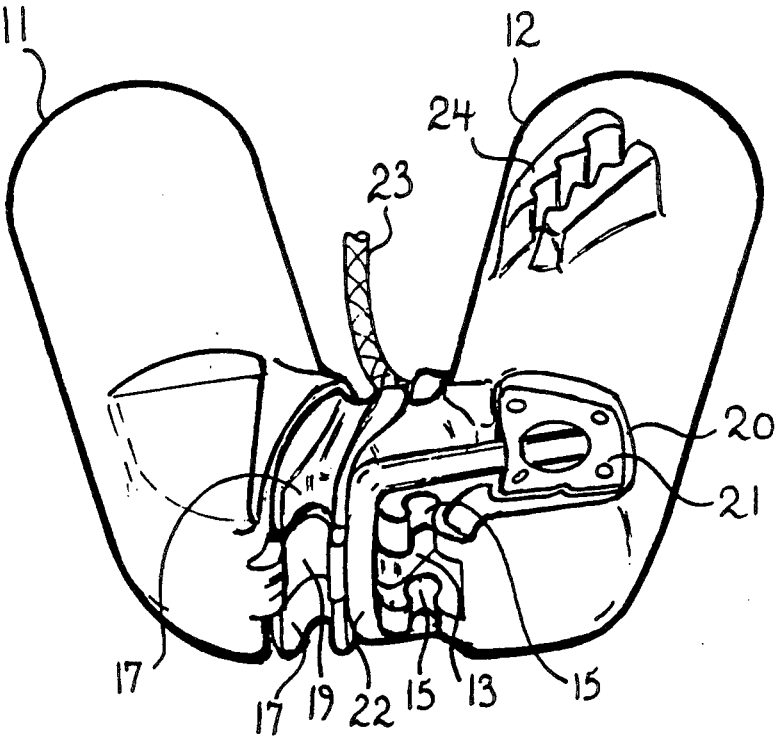
FIG. 6 is an isometric view of the members according to the embodiment in an engaged position.
Figure 5:
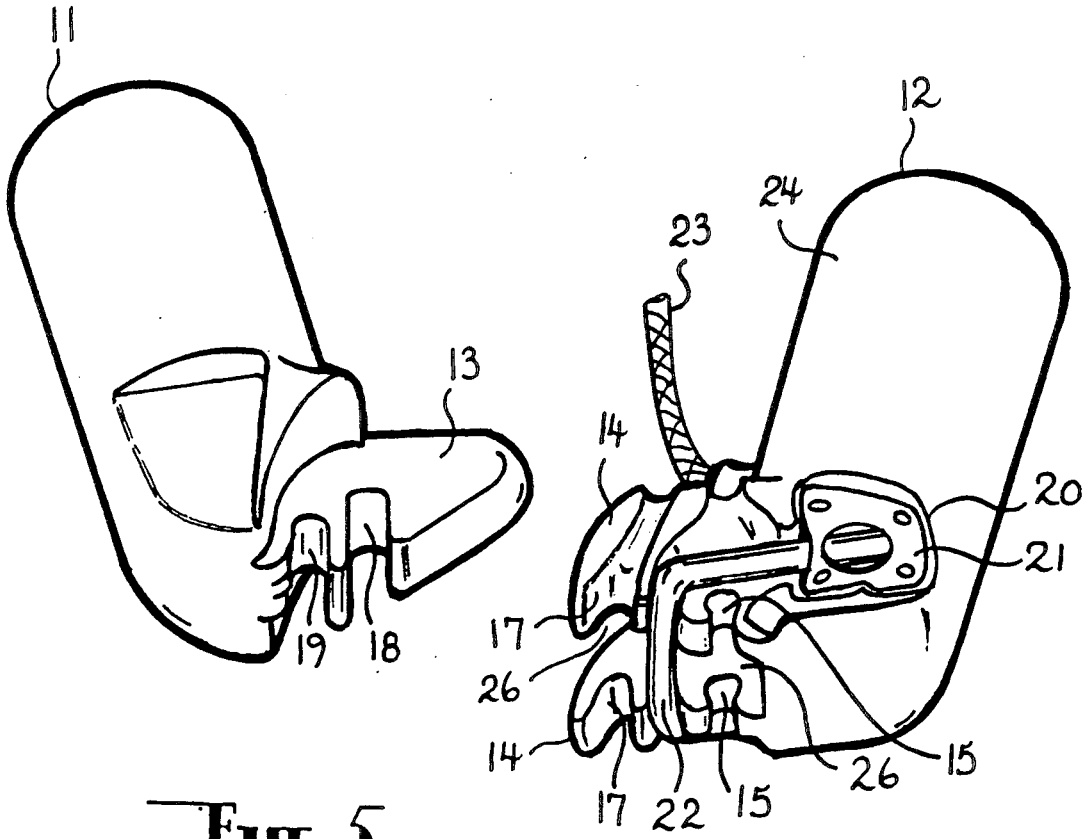
FIG. 5 is an isometric view of both members of the embodiment in a separated condition.

The embodiment comprises a pair of members 11 and 12 which are formed to be receivable over the ends of the boom members of a wishbone boom. One member 11 is formed with a transversely directed pawl member 13 while the other member 12 is formed with a transversely directed socket 26 (as shown as FIGS. 5 and 6) provided between a pair of transversely spaced cheek members 14 whereby the pawl is snugly engaged with between the cheek members 14. The pawl member 13 has a plate-like configuration and has an inner edge 25 which has a curved profile between the end of the pawl member and the junction of the pawl member most adjacent the respective boom member. The inner face of the socket between the cheek member 14 is formed to be complementary to the curved profile of the inner edge 25 of the pawl member to prevent relative movement between the members 11 and 12 in a direction parallel to the main axis of the boom. In addition the inter-engaged curved surfaces of the pawl and socket allow for pivotal movement between them about the control axis of the clew fitting which is perpendicular to the plane of the boom. The outer face and outer edge of the cheek members 14 are formed with three transversely directed slots 15, 16 and 17 which are directed rearwardly from the clew fitting while the edge of the pawl member 13 remote from the inner edge 25 is formed with a pair of transversely directed slots 18 and 19 which are directed rearwardly of the clew fitting and are located such that they align with the central and outermost slots 16 of the cheek members 14 when the pawl 13 is in inter-engagement with the socket between the cheek members 14. The other member 12 is formed with a hollow 20 adjacent the base of the socket which accommodates a resilient block 21. The resilient block 21 in turn supports a U-shaped latch member 22 such that the arms of the latch member are affixed into the resilient block 21 and the web of the latch member is received within the central slot 16 in the other member and will be received in the outermost slot 18 in the pawl of the one member 11 when the members are inter-engaged. The resilient nature of the resilient block 21 serves to resiliently retain the latching member in engagement with the central slot 16 in the cheek member. The pawl member 13 and the socket with which it becomes engaged is shaped such that on movement of the pawl member 13 into engagement with the socket, the latching member is engaged by the pawl member to be lifted out of the control slot 16 until such time as the outermost slot of the pawl member 13 becomes engaged with the latch member at which position the latch member will move into latching engagement with both sockets to retain the pawl 13 in engagement with the socket and prevent separation of the members. The other member further supports a length of rope 23 which is used to retain the clew of the sail in engagement with the clew fitting. Once the boom members are inter-engaged by engagement of the pawl member 13 with the socket of the one and other member respectively, the rope (as shown in FIG. 4) is passed through the eyelet provided in the clew of the sail and is then passed around the outer face of the other member such that is becomes engaged with the slots 19 and 17 of the cheek members and pawl member respectively. The rope is then caused to pass through the eyelet in the clew of the sail again, then back over the rear face of the clew fitting to be engaged with the inner-most slot 15 on the other member to overlie an intermediate portion of the latching member 22 and retain it in engagement with the slots 16 and 18. The rope is then engaged in the cleat element which is provided in the other member 12 to retain the rope in position.

As a result of the embodiment, a clew fitting is provided for a sailboard boom which readily facilitates the engagement and inter-engagement of the boom members of the boom and at the same time provides a positive engagement between the clew of the sail and the boom.

It should be appreciated that the scope of the present invention need not be limited to the particular scope of the embodiment described above.

THE CLAIMS defining the invention are as follows:

I claim:

1. A sailboard wishbone boom clew fitting comprising a pair of clew-fitting members wherein one clew-fitting member is adapted to be mounted to one end of one boom member and the other clew-fitting member is adapted to be mounted to one end of another boom member, the one clew-fitting member having a transversely directed pawl member and the other clew-fitting member being formed with a transversely directed socket, said socket being complementary to the pawl member whereby the pawl member is snugly receivable in the socket along said transverse directions wherein one of the clew-fitting membes is provided with a latch member pivotably supported to swing towards and away from said one clew-fitting member, said latch member being resiliently biased into a position where it will be engaged with the pawl member and socket to prevent the disengagement thereof and wherein said clew-fitting members when engaged provide a support surface to slidably receive a rope which fixes the clew of a sail to the clew fitting.

2. A clew fitting as claimed in claim 1 wherein the support surface comprises first slot formed in the pawl member and the outer face of the other clew-fitting member in the region of the socket wherein the said first slots are aligned when the pawl member and socket are inter-engaged, said slots being located remote from the clew of the sail and are shaped to receive the rope.

3. A clew fitting as claimed in claim 2 wherein the latch member is U-shaped and has arms which extend across the first slot.

4. A clew fitting as claimed in claim 2, wherein the latch member is engagable in a second slot provided in the pawl member and the outer face of the other clew-fitting member in the region of the socket said second slots being aligned when the pawl member and the socket are engaged.

5. A clew fitting as claimed in claim 2 wherein the support surface further comprises a third slot formed in the outer face of the other clew-fitting member in the region of the socket, said slot being located remote from the clew of the sail and shaped to accommodate the rope.

6. A clew fitting as claimed in claim 1 wherein one end of the rope is fixed to one of the members and wherein a cleat is provided on one of the clew-fitting members for receipt of the rope.

7. A clew fitting as claimed in claim 6 wherein the rope is supported from the other clew-fitting member.

8. A clew fitting as claimed in claim 6 wherein the cleat is provided on the other clew-fitting member.

9. A clew fitting as claimed in claim 1 wherein the latch member is supported by one of the clew-fitting members by a support member formed of resiliently deformable material which provides the resilient biassing, said support member being fixed to one of the clew-fitting members.

10. A clew fitting as claimed at claim 9 wherein the latch member is U-shaped having a pair of arms connected by a web member whereby the arms of the latch member are received in and supported from the support surface and the web of the latch member is engagable with the inter-engaged pawl member and socket.

11. A clew fitting member as claimed in claim 1, wherein said pawl member, when inter-engaged in said socket, is capable of rotating pivotal movement in the socket about an axis which is substantially centrally located between the clew-fitting members and is perpendicular to the plane of the boom.

12. A clew fitting as claimed in claim 1 wherein the latch member is supported from the other clew-fitting member.

13. A clew fitting for a sailboard wishbone boom having a pair of boom members in the general shape of a wishbone, which clew fitting comprises:

a pair of engageable clew fitting members each adapted to mount on an end of one of said boom members;

a pawl member extending in a transverse direction from one of said clew fitting members;

a socket member extending in a transverse direction from the other of said clew fitting members;

a latch member pivotably supported on one of said clew-fitting members positioned, configured and dimensioned to swing towards a latching position with respect to the engaged assembly of said pair of engaged clew members; and resilient biasing means acting to urge said latch member into said latching position, a support surface being defined by said engaged clew fitting members for slidably accommodating a retaining rope for securing the clew of a sail to the clew end of the wishbone boom, wherein said pawl member is snugly receivable in said socket along the line of said transverse directions, said latch member is openable against said resilient biasing member by interengagement of the clew fitting members, and said latch member is closable in a direction of spring bias provided by said resilient biasing means to lock said clew fitting members in said engaged position.

* * * * *